United States Patent [19]

Grebe et al.

[11] Patent Number: 4,654,981

[45] Date of Patent: Apr. 7, 1987

[54] DRYING APPARATUS FOR SLICED VENEER

[75] Inventors: Ingo Grebe, Neuenstein; Walter Münch, Bebra, both of Fed. Rep. of Germany

[73] Assignee: Babcock-BSH Aktiengesellschaft, Krefeld, Fed. Rep. of Germany

[21] Appl. No.: 702,554

[22] Filed: Feb. 19, 1985

[30] Foreign Application Priority Data

Feb. 17, 1984 [DE] Fed. Rep. of Germany ..... 3405754

[51] Int. Cl.[4] ..... F26B 13/04; F26B 13/08

[52] U.S. Cl. ..... 34/114; 34/115; 34/116; 34/155; 34/159; 34/161

[58] Field of Search ..... 34/114, 115, 116, 118, 34/122, 155, 159, 161

[56] References Cited

U.S. PATENT DOCUMENTS

| | | | |
|---|---|---|---|
| 2,671,279 | 3/1954 | Blanchard | 34/159 |
| 3,199,213 | 8/1965 | Milligan et al. | 34/13.8 |
| 3,280,476 | 10/1966 | Hildebrand | 34/13.8 |
| 3,698,049 | 10/1972 | Fleissner | 34/115 |
| 3,896,559 | 7/1975 | Martin | 34/161 |
| 3,956,832 | 5/1976 | Justus | 34/116 |
| 4,117,699 | 10/1978 | Renaut | 34/118 |
| 4,297,794 | 11/1981 | Luthi | 34/122 |
| 4,417,406 | 11/1983 | Eibich | 34/155 |
| 4,442,876 | 4/1984 | Koike et al. | 34/116 |

FOREIGN PATENT DOCUMENTS

| | | |
|---|---|---|
| 1266233 | 4/1968 | Fed. Rep. of Germany . |
| 1729208 | 6/1975 | Fed. Rep. of Germany . |

*Primary Examiner*—Albert J. Makay
*Assistant Examiner*—David W. Westphal
*Attorney, Agent, or Firm*—Karl F. Ross; Herbert Dubno

[57] ABSTRACT

A drying apparatus for sheets of sliced veneer has two conveyor belts lying one above the other running together jointly around a partially curvilinear, looped path guided by a plurality of guide apparatuses, the belts being positioned so that the sheets may be inserted between the belts for transport in a direction transverse to their widths, wherein the conveyor belts run rectilinearly between at least two of the adjacent guide apparatuses for a distance at least equal to half the maximum width of the sheets fed between the belts. The guide apparatuses may be rotatable cylindrical structures, for example rollers or cylinders, whose axes of rotation preferably all lie in the same horizontal plane. These rotatable cylindrical structures may be provided with brakes, drying and heating units as well. Furthermore the drying apparatus provides a velocity difference between the belts of from 2% to 5% and the belts passing between adjacent pairs of rollers are inclined at angles from 30° to 75°.

23 Claims, 6 Drawing Figures

DRYING APPARATUS FOR SLICED VENEER

FIELD OF THE INVENTION

Our present invention relates to an apparatus for the drying of sheets of sliced veneer and, more particularly, to the drying of veneer sheets free from crack formation.

BACKGROUND OF THE INVENTION

Sliced veneer is produced by shaving individual sheets of veneer from a log. These sheets are extremely thin (usually 0.5 to 0.7 mm in thickness). The sheet length is measured in the direction of fiber length and depends upon the slicer blade length and the length of the log. The width of the sheet of veneer, extending transversely to the fiber and the length of the sheet, depending upon the log can range from 200 to 1000 mm.

Known veneer drying processes involve guiding individual pieces of veneer between two conveyor belts, one lying above the other. According to the particular form of the belts, for example wire netting, a smoothing effect caused by the weight of the upper or covering belt may occur. This smoothing effect is, however, not sufficient in prior art belt drying processes to prevent the appearance of wavelike imperfections on the product during drying.

In roller drying in which the veneer is guided between rollers arranged one above the other, a comparatively higher pressure is applied to the veneer and because of that higher pressure a better smoothing effect can result.

Roller driers have disadvantages which are especially serious for sensitive and highly valuable thin veneers. Such veneer needs a certain inherent rigidity with which it can be fed from roller pair to roller pair. This is not available in most thin or moist veneer. When veneer shrinks during the drying process, generally by around 12%, stresses are created which particularly destroy thin veneer in this type of drying apparatus, i.e. the shrinkage while the veneer is relatively firmly held by the rollers causes tearing and crack formation.

In belt driers it is possible to shrink the laminate material between the belts to avoid crack formation. Also feed of thin, moist veneer between the belts is problem free. However, the weight of the covering belt is generally and disadvantageously not sufficient to smooth the veneer satisfactorily.

This veneer will therefore often be dried in belt driers and subsequently smoothed in a smoothing press, in order to remove wavelike imperfections developed in the product during the drying process.

In the belt drier of German patent document—Printed Application DE-AS 1 266 233, the piece to be dried is guided on a curved, looped path around staggered rollers. The web to be dried is entrained between two endless smooth wire fabric belts, which are passed zig-zag-wise in a controllable arrangement about the rollers with an elevated belt tension.

This increased tension generates a smoothing pressure which is applied to the web between the belts.

In this drying apparatus the shrinking of the veneer or plies during drying is not considered. The smoothing pressure is applied continuously to the veneer which is continuously squeezed between the belts. Therefore shrinking without cracking is not possible in this prior art apparatus. Indeed this kind of belt drier has yet to be effectively commercialized.

OBJECTS OF THE INVENTION

The principal object of our invention is to provide a belt drying apparatus with which it is possible to achieve a clearly improved quality product without cracking of sliced veneer.

It is another object of our invention to provide an improved drying apparatus for sliced veneer which produces a product which has a smooth, crack free surface It is yet another object of this invention to provide an improved drying apparatus for sliced veneer which produces a smooth, dry, unmarred product without breaking or cracking of the veneer.

SUMMARY OF THE INVENTION

These objects and others which will become apparent hereinafter are attained, in accordance with the invention, in a drying apparatus for sliced veneer sheets comprising two superposed conveyor belts lying one above the other which are guided over a loop-shaped path around arcuate guide members, for example, drums, cylinders or rollers which will be referred to hereinafter as drying drums and which can rotate about respective axes lying in a common plane, usually a horizontal plane.

The sliced veneer sheets are placed between the perforate or openwork (wire-screen) belts which hold and carry the webs to an intake area or zone and then transport the webs into a preferably ventilated drying chamber. The dried sliced veneer is recovered from the belts after drying in an output area or zone.

According to the invention the conveyor belts run rectilinearly between successive guide members which, as noted, are preferably rotatable cylindrical structures, i.e. drums, rollers or cylinders, for a distance at least equal to half the maximum width (dimension in the transport direction transverse to the fibers). This guarantees that each veneer sheet is free of applied pressure at least at some point between each pair of guide members. In this manner the veneer sheets are free to shrink so that the occurrence of cracks is avoided.

Advantageously the guide drums are heated to prevent thermal stress and curling of the laminate material. The portion of the drying path formed by the array of drums should make up at least 20% of the total path.

The conveyor belts passing between adjacent guide drums preferably are inclined at angles from 30° to 70°, preferably about 60° to the horizontal to help prevent sliding of sliced veneer sheets between the pair of belts to prevent abrasive damage to the sheets. A velocity difference between the belts of 1% to 12%, preferably 2% to 5%, is found to lead to an improved product and help prevent cracking.

A better quality product is obtained more efficiently, according to the invention, if the proportion of the conveyor path which is provided by the guide drums is at least 40% of the entire path and is preferably from 50% to 70% thereof. Alternatively, an excellent drying of sliced veneer is obtained in a drying apparatus having a significant rectilinear portion (at least 20%) of the conveyor path before the first guide apparatus is reached, preferably 35% to 55%. In that case the proportion of the path which is formed by the guide drums is less, preferably from 25% to 50%.

The drying efficiency is greatly improved if air or some other heated drying agent is blown from a plurality of nozzles perpendicular to the conveyor belt distributed along the length of the belt. Furthermore the heating agent may also be blown from nozzles onto the rotatable cylindrical structures or the sliced veneer.

The conveyor belt is advantageously constructed from a nonelastic material, preferably a woven metal fabric. These belts are thus advantageously formed with a plurality of small holes therein to facilitate contact of the drying or heating agent and the sliced veneer, while allowing pressure to be applied and providing a surface for smoothing.

Alternate rollers or cylinders can be attached to a chain drive for rotation, but it is particularly advantageous to rotate the cylindrical guide drums using smaller driven running rollers positioned along the peripheries of the larger guide drums. If a perforated hollow cylinder is used as the guide drum, then a drying or heating agent (fluid) may be blown from the interior of the cylinders through the belts lying against them to dry the sliced veneer. A heating agent may also be supplied.

By alternately looping the conveyor belts under and over adjacent cylindrical guide drums placed in succession side-by-side in the drying chamber a periodic displacement of the belts against one another is achieved during operation. This periodic motion of the belts helps to smooth the drying of the sliced veneer and ensure uniformity of drying with treatment from alternate sides.

Most advantageously at least four and preferably six to twelve drums are provided along the transport path. Means is preferably provided to vary the tension of the respective belt. Such means can be provided in addition to or in the form of a brake selectively operable for each drum or for selected guide drums. At least two brake units can be provided for each of two drums rotating in the same sense.

The nozzles which are provided to treat the webs with the heating and drying fluid, are advantageously directed substantially perpendicularly to the web, the nozzles communicating with manifolds or windboxes and being located within the drums which may be perforated and/or around the peripheries of the drums overshot or undershot by the belts carrying the webs between them.

The path can include a plurality of drying zones assembled from modular units, each including two such drums one of which is overshot and the other of which is undershot by the belts, and the associated nozzles.

When the sliced veneer is dried in the preferred embodiment of the novel drying apparatus described below a comparatively more complete drying results with less than 12% residual moisture left in the product. This allows further work to proceed simply without difficulty.

BRIEF DESCRIPTION OF THE DRAWING

The above and other objects, features and advantages of this invention will become more readily apparent from the following detailed description, reference being made to the accompanying diagrammatic drawing in which.

SPECIFIC DESCRIPTION

Figure 1:
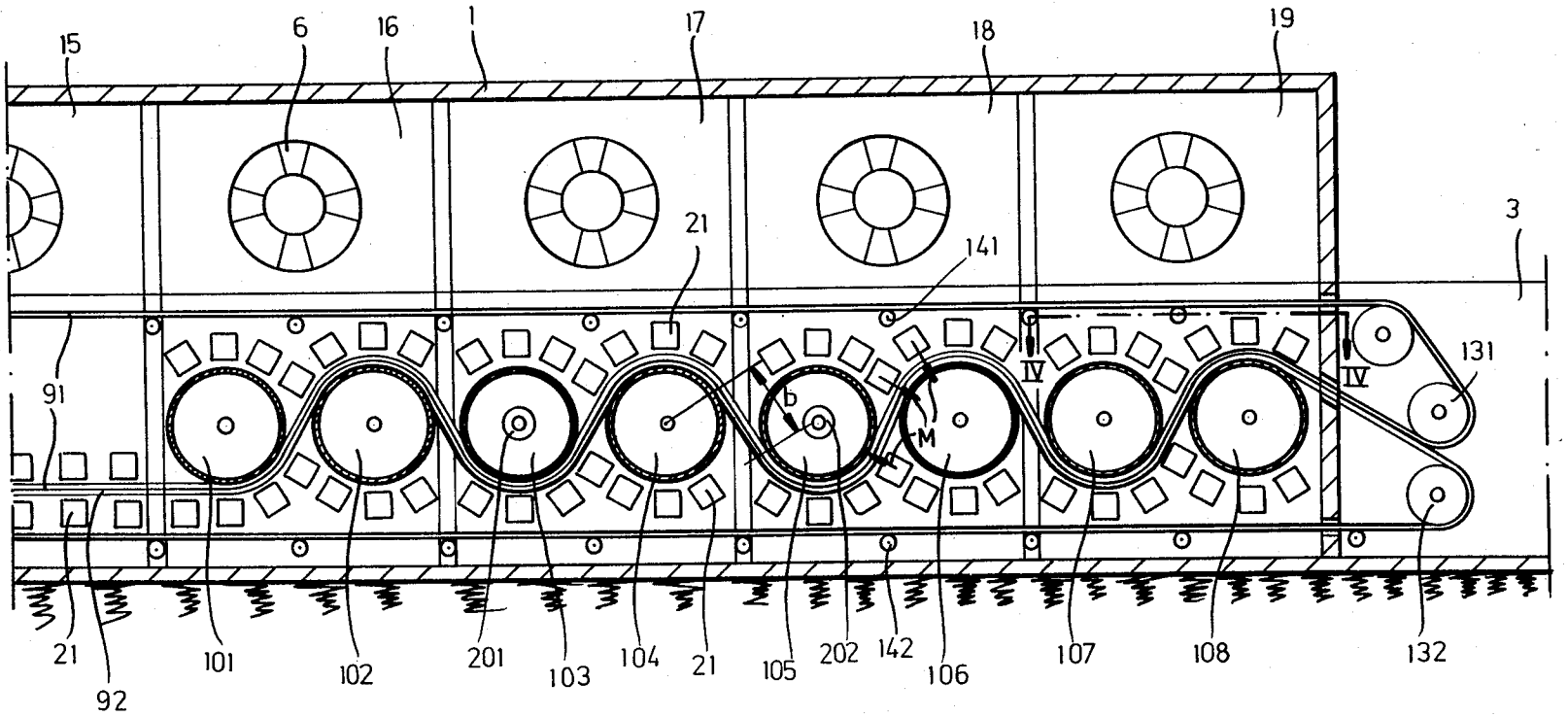
FIG. 1 is a lengthwise vertical cross sectional view of a preferred embodiment of the drying apparatus of this invention.

The drying apparatus of this invention in a preferred embodiment which comprises a sealed or generally closed drying chamber 1, which is divided into a plurality of areas or zones 11, 12, 13, 14, 15, 16, 17, 18, and 19, preferably of a modular construction so that any number of zones can be assembled into a drying apparatus for a particular purpose. At the drying apparatus entrance an intake zone 2 is found and the final drying apparatus zone 19 is connected to an output zone 3. The output zone 3 is connected with a cooling zone 4 by means of a conveyor belt system 5. The sheets of sliced veneer can then proceed from the cooling zone 4 to other areas where further work is done, i.e. a lamination may be carried out.

Each drying zone 11 to 19 has a ventilator 6 and an unshown heat exchanger with an adjustable heat supply means; the heat supply utilizes burners, hot water, steam or the like. Furthermore the drying chamber 1 is provided with an exhaust flue 7 which is connected to the chamber interior by way of a controllable outlet trapdoor or damper 8. In this way the required drying climate may be maintained in each of the zones 11 to 19.

The conveyor system through the drying chamber for the sliced veneer is a belt conveyor, which comprises two endless belts 91 and 92. Additionally the lower strand of the upper belt 91 (the covering belt) and the upper strand of the lower belt 92 (the supporting belt), being directly juxtaposed are guided together rectilinearly through the first five zones 11 to 15 but in passing through the zones 16 to 19 are looped around the drums 101 to 108 which can be solid rollers in the embodiment shown in FIGS. 1 and 3 or the drums 111 to 118 which are hollow in the embodiment of FIG. 2. In the horizontal direction the sheets of sliced veneer are entrained by the belts in succession and enter the zone 16 from the zone 15 horizontally and pass horizontally under the drum 101 but are bent upwardly around the drum 101 at an angle of 60° up from the horizontal (or at a 120° angle as measured between the belt segments).

They then continue upwards in a straight line out of contact with any of the drums for a rectilinear distance b.

In a typical practical examble b is about 50 cm.

This linear portion lies tangentially to the roller 101 and to the following roller 102.

On the upper part of the roller 102 the rectilinear tangential belts 91 and 92 are bent at an angle of about 120° from their otherwise rectilinear direction (or at an angle of 60° as measured between the bent belt segments). This curvilinear guided belt portion has an arc length of about 90 cm in the example provided here.

A rectilinear portion out of contact with rollers of length b again follows this bent portion which is directed slantingly downwards lying tangentially to the roller 102 as well as the following drum 103.

Both passes from the belt 91 and 92 will likewise be bent around the drum 103 at an angle of about 120° from their rectilinear path.

Figure 4:
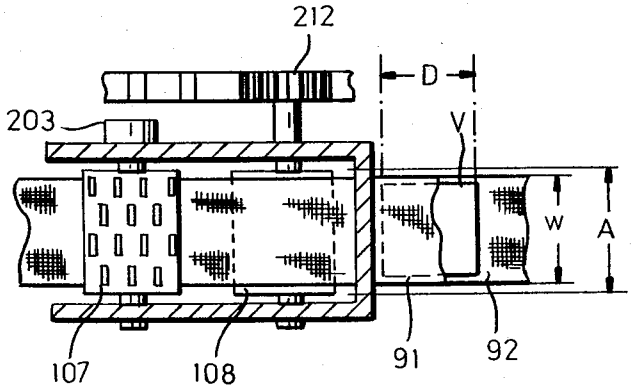
FIG. 4 is a section taken along the line IV—IV of FIG. 1 with the nozzles and manifolds broken away.

Correspondingly the juxtaposed passes of the belts 91 and 92 will similarly wind alternately over and under the drums 104 to 108, wherein the support belt 92 and the covering belt 91 alternate to lie on the outer surface of the drum under consideration. From the last drum 108 the belts run slantingly downwardly toward the guide rollers 131 and 132. In the zones 16 to 19 the juxtaposed belts 91 and 92 run in a zig-zag pattern around the drums 104 to 108. This alternately curved path through the drying chamber 1 appears to be either a rounded sawtooth shaped curve or a sinusoidal-like curved course. The length of the entire joint conveyor segment in the drying apparatus in the particular embodiment shown amounts to somewhat more than 20 m. The length b (FIG. 4) is at least one half the width D of the veneer sheet. The length of the sheets will generally be less than the width w of the belts and the lengths A of the drums or rollers.

The part of the rectilinearly running conveyor segment before the first roller is about 10 m, that is about half of the entire joint conveyor segment.

In the vicinity of the zig-zag portion of the conveyor path the length of the curvilinear part of the joint conveyor segment (that is, that part of the joint conveyor segment without the intervening rectangular portions) adds up to exactly 7 m, that is about 32% of the entire joint conveyor segment and about 60% of the joint conveyor segment in this vicinity.

Likewise other similar embodiments are possible in which guide drums are arranged along the entire joint conveyor segment. Then the fraction of the curvilinear portion of the joint conveyor segment exceeds 40%. It has been shown that it is particularly propitious if from 50% to 70% of the joint conveyor segment is in this form.

In output zone 3, where a joint drive 112 for the conveyor system is located, the belts 91 and 92 of the guide rollers 131 and 132 respectively will be guided away from each other and fed back to the drying apparatus entrance support on the rollers 141 and 142 respectively. There they are brought together with the aid of additional guide rollers 151 and 152 (FIG. 3) which are constituent parts of the intake zone 2, in which each belt 91 and 92 runs through a tension regulator 161 and 162 respectively, with which the operating tension in the belts 91 and 92 is adjusted. The tension devices 161 and 162 each comprise a guide roller whose position can be hydraulically altered.

The belts 91 and 92 are preferably made from a nonelastic material. It is possible that they should have a fixed elasticity that will guarantee that they are in the position to produce the desired applied pressure on the rollers and guide rollers by means of a suitable operating tension. They have openings for the drying agent, for example hot air, which are as small as possible, in order that the largest possible pressing surface be provided for the veneer. Further the belts are so provided that the sliced veneer sheets can slide to and fro thereon (and vice versa) without marking the veneer surface involved. In practice flat spiral wound wire net belts or flat spiral woven wire belts (e.g. of round cross section wire) are preferred for the belts of this invention.

Figure 3:
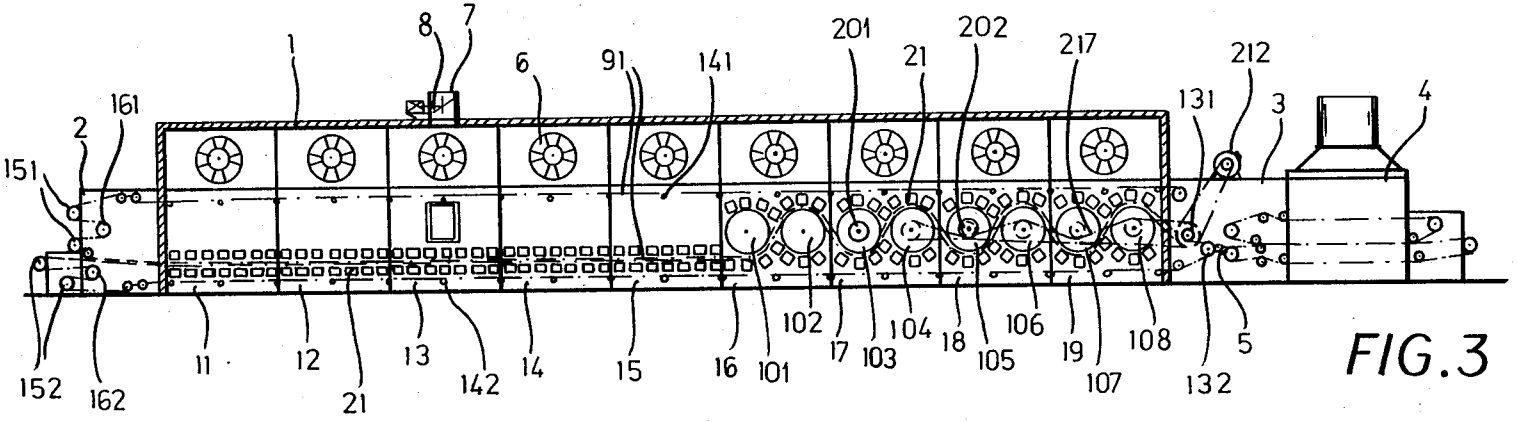
FIG. 3 is a lengthwise cross sectional view through a complete drying apparatus according to the embodiment of FIG. 1.

The belts 91 and 92 are driven by the drums, which are connected to the drive 212, as seen in FIG. 3. In operation a velocity difference of 2% is maintained between the belts 91 and 92 in this preferred embodiment, while velocity differences of from 1% to 12% may be used.

The drums are all of equal size.

In this specific embodiment eight drums are used. They are positioned with slight spacing next to one another with their rotation axes all in the same horizontal plane. Two drums are provided in each zone. For space saving it is likewise possible to arrange the drums at different heights, for example so that some of the rotation axes are found in a second higher lying horizontal plane.

Figure 2:
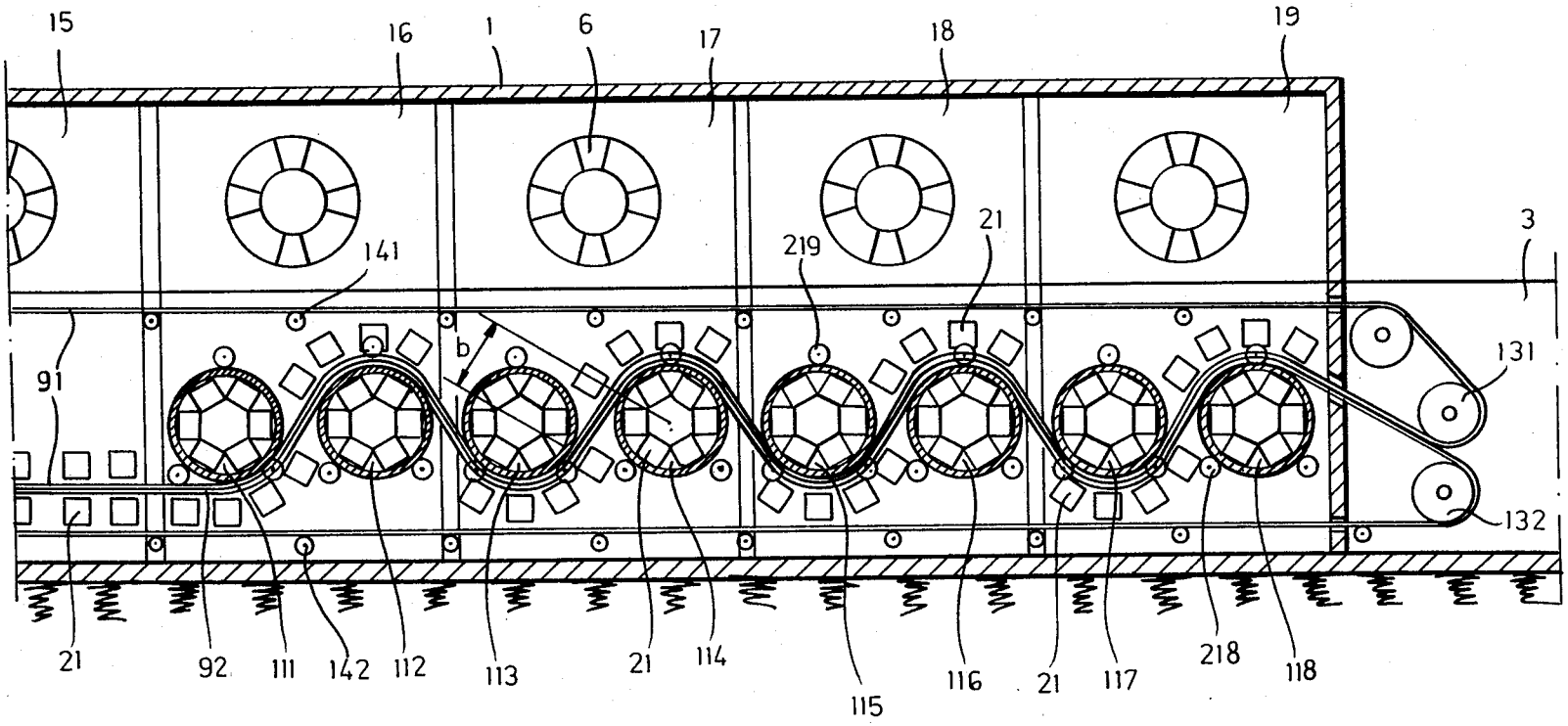
FIG. 2 is a lengthwise vertical cross sectional cutaway view of another embodiment of the drying apparatus of this invention.

The embodiments of FIGS. 1 and 2 have different drive systems: On the front side of each drum, shafts are attached which are journaled on the housing. Every second drum 102, 104, 106, 108 overshot by belts 91 and 92 is driven by a common chain 217 which engages sprockets on shafts on the opposite sides.

In the embodiment of FIG. 2 the drums rest on and are peripherally engaged by driven running rollers 218. The drums 111, 113, 115, etc. around which the belts 91 and 92 pass on their undersides, are braced and engaged by additional rollers 219 on their upper side.

The rollers 218 and 219 roll on a race (not shown) which is part of each drum and at opposite axial ends thereof. The undriven rollers 101, 103, 105, etc. and/or the undriven drums 112, 114, 116, etc. may be provided with brakes, with which by braking both the belt tension and also the velocity difference between the belts 91 and 92 are adjustable. In the embodiment of FIG. 3 two rollers 103 and 105 have this type of brakes, disk brakes 201, 202. A third brake is shown at 203.

It is essential for the invention that the belts 92 and 91 which pass alternately jointly around the drums, run from the curvilinear transition region of one drum in a straight line for a distance b to the next drum. This distance b must be at least half the maximum sliced-veneer sheet width D (from 20 to 100 cm usually). This is achieved by not positioning adjacent rollers or cylinders directly next to one another, but by providing clearance between them.

In the drying chamber 1 a plurality of nozzles 21 are located along the joint conveyor segment. They are employed to provide hot air or another drying agent perpendicularly to the sliced veneer sheets between the belts.

In the specific embodiment of FIG. 1 the nozzles 21 are arranged both above and below the rollers along circular arcs. Alternately in the specific embodiment according to FIG. 2: Nozzles 21 are provided inside the cylinders as well. The cylinders have no base, additionally their walls are provided with slots. Hence hot air is forced through the cylinder walls from the nozzles 21 inside the cylinders and is blown onto the inwardly lying sliced veneer sheet. In the interior of the cylinders an alternative heating system can be installed, for example an oil or a gas burner, with which the cylinders may be heated directly. The nozzle jet direction is represented by the arrows M, i.e. are perpendicular to the sheets V.

Sliced veneer sheets can be inserted into the drying apparatus individually at the intake zone 2. On running through they lie between the support and covering belts, wherein the covering belt with its weight provides a certain smoothing effect. The weight of the covering belt and the difference in belt velocities are such that the sheet veneer is not prevented from shrinking during drying. On passage through the zones 11 to 15 the laminate material will be predried with hot air from the adjacent nozzles 21. Preferably predrying will continue until the fiber saturation point is reached.

From zone 16, therefore from the first drum 101 or 111, the laminate material will be guided on a curved path through the stationary drying apparatus.

By the guide rings along the circular arc shaped path a radial pressure results which presses perpendicularly on the upper surface of the sheet veneer. This occurs each time the outer belt (on the first drum 101 or 111 the lower belt 92) presses the veneer sheet against the inner belt, which happens when the belts contact the drum 101 or 111.

By the high pressure resulting, the sliced sheet veneer is smoothed.

A free shrinkage is not possible in this phase of application of high pressure. The belts 91 and 92 are so formed that the veneer surface will not be marked with imperfections. The operating pressure is adjustable for every requirement by way of the tension on the belts 91 and 92 with tension regulators 161 and 162. The velocity difference between the belts 91 and 92 and the distribution of tension may be partially regulated with the brakes 201, 202, 203.

The belts 91 and 92 run out of contact with drums in a transitional segment between two rollers or cylinders for a distance b in a straight line. During this straight transitional feed no pressure is placed on the veneer sheet—that is with the exception of pressure applied perpendicularly to the veneer sheet by the weight of the covering belt—thus the veneer can now freely shrink. The components of the weight perpendicular to the conveyor belt may vary by way of the angle of inclination of the conveyor belt to the horizontal; in this example, this amounts to about 60°. It has been shown that this angle on account of the tendency of veneer sheet to slip should not be allowed to grow arbitrarily large. By providing a minimum rectilinear segment for straight running between adjacent cylinders or rollers, it is guaranteed that each fiber of the veneer has sufficient time to shrink freely so crack formation between neighboring fibers will be prevented.

The drums rotate in alternately opposite senses of rotation. By this guiding both sides of the veneer sheet will be equally processed. Moreover this type of rotary motion produces a to and fro motion of the belts 91 and 92 against one another. By these motions of the belts 91 and 92 the veneer sheet will be smoothed. The strength of the relative motion against one another may be influenced by the thickness of the belts 91 and 92 among other things, because of differences in the guide radiuses. The smoothing process will be assisted by the velocity difference between both belts 91 and 92 which can be influenced by the brakes 201 and 202.

In the embodiment of FIGS. 1 and 3 for prevention of temperature differences between the outer surface of the veneer sheet outer and inner surfaces—the inner surface being covered by the roller walls—the rollers with their sides lying against the conveyor path will have hot air blown on them from nozzles 21 and therefore will be heated. This heat will be transferred by radiation to the veneer sheet.

In the specific embodiment with the cylinders the laminate inner side is directly treated with hot air through slots in the cylinder side wall. With the nozzles 21 inside the cylinder a sufficient quantity and control of the hot air stream is achieved.

The veneer sheet leaves the drying chamber 1 from the output zone 3, from which it is carried to the cooling area 4 by the conveyor system. There the veneer sheet is cooled and connected to other dried webs if desired.

The term rotatable cylindrical structures refers to both guide cylinders and guide rollers.

Figure 5:
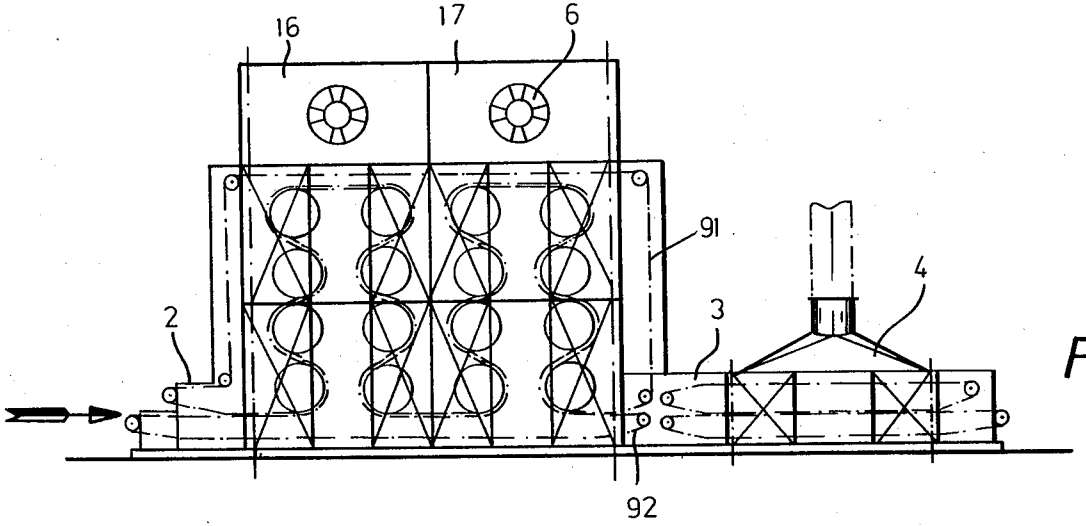
FIG. 5 is a vertical section through a veneer dryer according to the invention which differs from that of FIGS. 1–3 in that the overall length of the apparatus is shortened by providing vertical path portions for the two belts sandwiching the veneer sheets between them.
Figure 6:
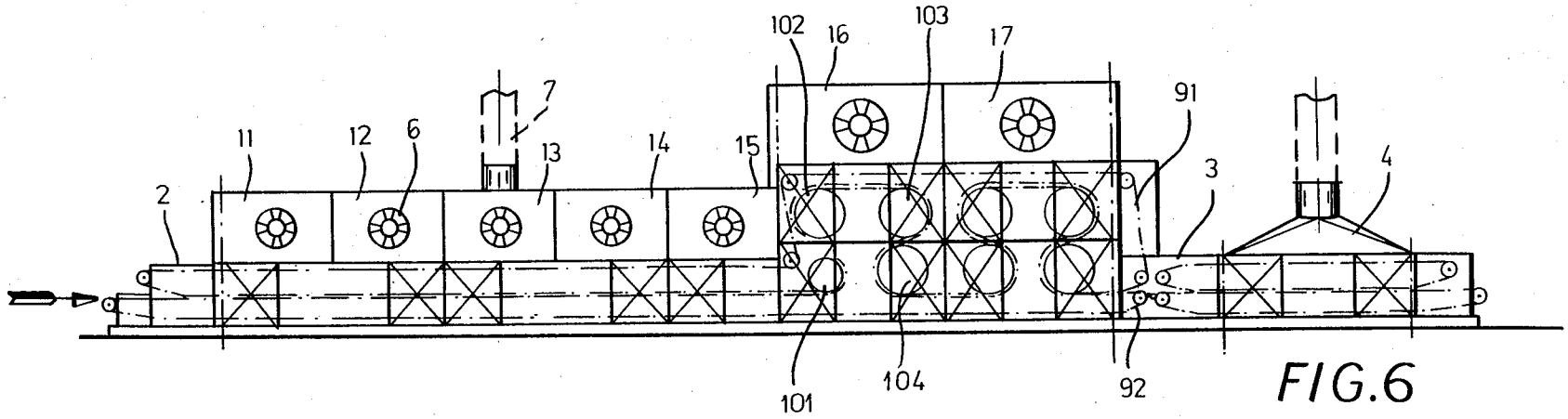
FIG. 6 is a diagrammatic vertical section representing the layout of a plant which is a hybrid between that of FIGS. 1–3 and that of FIG. 5.

As represented by FIGS. 5 and 6, the veneer dryer of the invention can also have its belt-deflection rollers or drums in different planes. In the embodiment of FIG. 6, for example, connected to the zones 11–15 which define a linear path for the fluid-permeable belt and the spaced-apart sheets of veneer sandwiched between these belts, is a pair of zones 16, 17, each of which comprises four rollers or drums in two vertical planes and in each zone the belts pass upwardly around the lower roller 101, then around an upper roller 102 to cross the second pair of rollers, thereupon passing downwardly around the upper roller 103 and around and below the lower roller 104.

Specifically, the two rollers of each pair are disposed in vertically superposed relation.

From the last zone 15 with its rectilinear path, the two belts 91 and 92 with the sheets of sliced veneer between them thus pass first upwardly, then horizontally and then downwardly before proceeding horizontally to the next zone 17 for movement in a similar manner before being discharged into the zones 3 and 4 previously described.

In the embodiment of FIG. 5, the next horizontal stretch is formed only by a short input side of the vertically elongated dryer which comprises two zones 16, 17, each being formed by eight drums or rollers including two groups of four, each in vertically superposed relationship. As the pair of belts 91 and 92 pass around the rollers in a zig-zag pattern first upwardly, then across to the next group, then downwardly, then across to the third group and then upwardly again and finally across and downwardly via the last group, the belts define a rectilinear stretch between each pair of successive drums or rollers of a length at least equal to half the maximum width of the sliced veneer sheets so that momentarily between each passage around rollers in alternately opposite directions, each veneer sheet is free to shrink without constraint except in the transverse direction, i.e. perpendicular to the plane and with light constraint in this direction so that cracking does not occur.

Naturally in the embodiment of FIG. 5 as well, a rectilinear stretch can precede the vertically elongated dryer.

In both embodiments the means for displacing the heated air is provided in accordance with the principles of the embodiments of FIGS. 1–3.

In a further embodiment which has not been illustrated, the rectilinear path instead being provided below the area of deflecting rollers can be provided at the upper level of the rollers of the superposed groups and indeed in a preferred embodiment the rectilinear path can lie in two horizontal planes above from 4–8 rollers whose axes of rotation can lie also in a horizontal plane.

We claim:

1. In a drying apparatus for sheets of sliced veneer having a maximum width, comprising two juxtaposed conveyor belts running together jointly along a drying path including a partially curvilinear looped path segment guided alternately over and under successive guide drums generally in one horizontal direction with said sheets of sliced veneer positioned between said belts and displaced in the direction of their widths, the improvement wherein said drums are fluid permeable, said conveyor belts press said sheets while extending around said drum but run rectilinearly out of contact with said drums between at least two of said guide drums for a distance at least equal to half the maximum width of said sheets, and nozzles are provided for training a drying medium against said sheets at a multiplicity of locations along said path and perpendicularly thereto where said sheets extend around said drums.

2. The improvement defined in claim 1, further comprising means for heating said guide drums.

3. The improvement defined in claim 1 wherein said segment of said path amounts to at least 20% of the entire path in length.

4. The improvement defined in claim 3 wherein said segment amounts to at least 40% of said entire path.

5. The improvement defined in claim 4 wherein said segment is from 50% to 70% of said entire path.

6. The improvement defined in claim 1 wherein said conveyor belts run inclined at an angle of between 30° to 75° to the horizontal where rectilinear between pairs of said guide drums.

7. The improvement defined in claim 6 wherein said conveyor belts run inclined at an angle of 60° to the horizontal between pairs of said guide drums.

8. The improvement defined in claim 1, further comprising drive means for maintaining a velocity difference of 1% to 12% between said conveyor belts.

9. The improvement defined in claim 8 wherein said velocity difference is from 2% to 5%.

10. The improvement defined in claim 1 wherein the path has a rectilinear segment before the first of said guide drums and said rectilinear segment is at least 20% of the length of the entire path.

11. The improvement defined in claim 10 wherein said rectilinear segment of said path is from 35% to 55% of the length of the entire path.

12. The improvement defined in claim 11 wherein the looped segment of said path is from between 25% and 50% of said entire path.

13. The improvement defined in claim 12, further comprising drive means maintaining a velocity difference between said belts of between 2% and 5%, said belts between adjacent guide drums being inclined at an angle from 30° to 75° to the horizontal.

14. The improvement defined in claim 1 wherein at least four such drums are provided along said segment.

15. The improvement defined in claim 14 wherein six to twelve such drums are provided along said segment.

16. The improvement defined in claim 14 wherein at least one of said drums is provided with a brake.

17. The improvement defined in claim 16 wherein at least two of said drums are provided with brakes, said drums with said brakes being driven in the same rotational direction.

18. The improvement defined in claim 1 wherein each of said belts is provided with a tension regulator.

19. The improvement defined in claim 1 wherein a plurality of nozzles located along said path blow a drying agent at said sheets essentially perpendicular to said path.

20. The improvement defined in claim 19 wherein said nozzles direct said agent at those portions of said belts lying against said drums.

21. The improvement defined in claim 19 wherein at least one of said drums is a hollow cylinder having at least one running roller lying adjacent said cylinder, and a heating system disposed within said cylinder.

22. The improvement defined in claim 21 wherein said cylinder is provided with a plurality of slots in a cylinder wall bearing on said belts and receives a plurality of nozzles directing a drying medium at said cylinder wall and through said wall upon said sheets.

23. The improvement defined in claim 1 wherein said drums have rotation axes lying in a single horizontal plane.

* * * * *